US006717565B1

(12) United States Patent
Kurosawa et al.

(10) Patent No.: US 6,717,565 B1
(45) Date of Patent: Apr. 6, 2004

(54) ILLUMINATING APPARATUS FOR A LIQUID CRYSTAL MONITOR AND A DIGITAL CAMERA HAVING A LIQUID CRYSTAL MONITOR UTILIZING AN ILLUMINATING APPARATUS THEREOF

(75) Inventors: Yuichi Kurosawa, Tokyo (JP); Tetsuya Abe, Tokyo (JP)

(73) Assignee: PENTAX Corporation, Tokyo (JP)

( * ) Notice: Subject to any disclaimer, the term of this patent is extended or adjusted under 35 U.S.C. 154(b) by 0 days.

(21) Appl. No.: 09/369,833

(22) Filed: Aug. 9, 1999

(30) Foreign Application Priority Data

Aug. 17, 1998 (JP) ..... 10-230693

(51) Int. Cl.[7] ..... H05R 41/42

(52) U.S. Cl. ..... 345/102; 345/77; 345/84; 345/87; 315/128; 315/160; 315/209; 315/226; 315/307; 315/308

(58) Field of Search ..... 345/87, 102, 84, 345/77; 315/128, 160, 209, 226, 307, 308

(56) References Cited

U.S. PATENT DOCUMENTS 5,338,110 A * 8/1994 Byun ..... 315/94
5,384,516 A * 1/1995 Kawabata et al. ..... 315/160
5,534,755 A * 7/1996 Deavenport et al. ..... 315/307
5,844,378 A * 12/1998 LoCascio et al. ..... 315/127
5,939,830 A * 8/1999 Praiswater ..... 315/169.3
5,962,981 A * 10/1999 Okude et al. ..... 315/128
5,994,843 A * 11/1999 Kataoka et al. ..... 315/106
6,118,415 A * 9/2000 Olson ..... 345/41
6,127,785 A * 10/2000 Williams ..... 315/224
6,295,109 B1 * 9/2001 Kubo et al. ..... 349/119

* cited by examiner

*Primary Examiner*—Bipin Shalwala
*Assistant Examiner*—Vincent E. Kovalick
(74) *Attorney, Agent, or Firm*—Greenblum & Bernstein, P.L.C.

(57) ABSTRACT

A liquid crystal monitor (LC monitor) illuminating apparatus utilizes a fluorescent lamp. The lamp is provided in a backlight portion to illuminate a liquid crystal monitor from behind. The fluorescent lamp is activated by a direct-current (DC) lighting circuit that is provided with a switching circuit which reverses the polarity of the DC lighting circuit. A digital camera with a liquid crystal monitor including an LC monitor illuminating apparatus is also disclosed.

7 Claims, 4 Drawing Sheets

ILLUMINATING APPARATUS FOR A LIQUID CRYSTAL MONITOR AND A DIGITAL CAMERA HAVING A LIQUID CRYSTAL MONITOR UTILIZING AN ILLUMINATING APPARATUS THEREOF

BACKGROUND OF THE INVENTION

1. Field of the Invention

The present invention relates to an illumination apparatus for illuminating a liquid crystal monitor and a digital camera having a liquid crystal monitor using the LC illuminating apparatus.

2. Description of the Prior Art

In general, in known digital cameras, a liquid crystal monitor (LC monitor) is used to view an object and an image of the object taken by the camera. To enable a viewer to view the LC monitor even in poor light, or in a dark place, a backlight is provided in the camera.

The backlight is configured to allow light, emitted from a fluorescent lamp incident upon the LC monitor through a light guide and a reflecting plate, to illuminate the surface of the LC monitor. In case of a fluorescent lamp that is a cold-cathode fluorescent lamp, an AC lamp lighting circuit, whose service life is 10000 hours on an average, is usually employed.

However, if the LC monitor is illuminated by a backlight having a fluorescent lamp which is lit by the AC lighting circuit, the image displayed on the LC monitor tends to be unclear due to noise caused by an invertor of the AC lighting circuit, thus resulting in a lower image quality than the image displayed on an LC monitor using a DC lighting circuit. To prevent this, it is theoretically possible to light the fluorescent lamp by a DC lighting circuit instead of the AC lighting circuit, so that the noise caused by the invertor can be reduced to thereby enhance the image quality. However, in the fluorescent lamp activated by the DC lighting circuit, a blackening phenomenon tends to occur within a shorter time span than in the fluorescent lamp activated by the AC lighting circuit. Consequently, the service life of the LC monitor is shortened.

SUMMARY OF THE INVENTION

It is an object of the present invention to provide a liquid crystal monitor illuminating apparatus wherein if the fluorescent lamp is activated by a DC lighting circuit to obtain a clear display of the LC monitor in which a noise caused by an invertor is restricted, a blackening phenomenon of the fluorescent lamp tends not to occur, thus resulting in an prolonged service life of the LC monitor.

Another object of the present invention is to provide a digital camera having a liquid crystal monitor using the LC monitor illuminating apparatus.

In order to achieve the above-mentioned objects, there is provided a liquid crystal monitor illuminating apparatus in which a fluorescent lamp provided in a backlight portion to illuminate a liquid crystal monitor from behind including: a direct-current lighting circuit which activates the fluorescent lamp; and a switching circuit which reverses the polarity of the direct-current lighting circuit.

Preferably, the switching circuit reverses the polarity of the direct-current lighting circuit every time the fluorescent lamp is activated.

Preferably, the switching circuit reverses the polarity of the DC lighting circuit every time a main switch, provided on a main body which sends indication data to the LC monitor, is turned ON.

Preferably, the switching circuit reverses the polarity of the DC lighting circuit at a predetermined time interval.

Preferably, the predetermined time interval is determined by a CPU, in accordance with a lapse time which is measured by measuring clock pulses which are generated by a clock generator which sends indication data to the LC monitor.

Preferably, the liquid crystal monitor illuminating apparatus is provided in a digital camera.

The present disclosure relates to subject matter contained in Japanese Patent Application No.10-230693 (filed on Aug. 17, 1998) which is expressly incorporated herein by reference in its entirety.

BRIEF DESCRIPTION OF THE DRAWINGS

The invention will be discussed below in detail with reference to the accompanying drawings, in which.

DESCRIPTION OF THE PREFERRED EMBODIMENT

Figure 1:
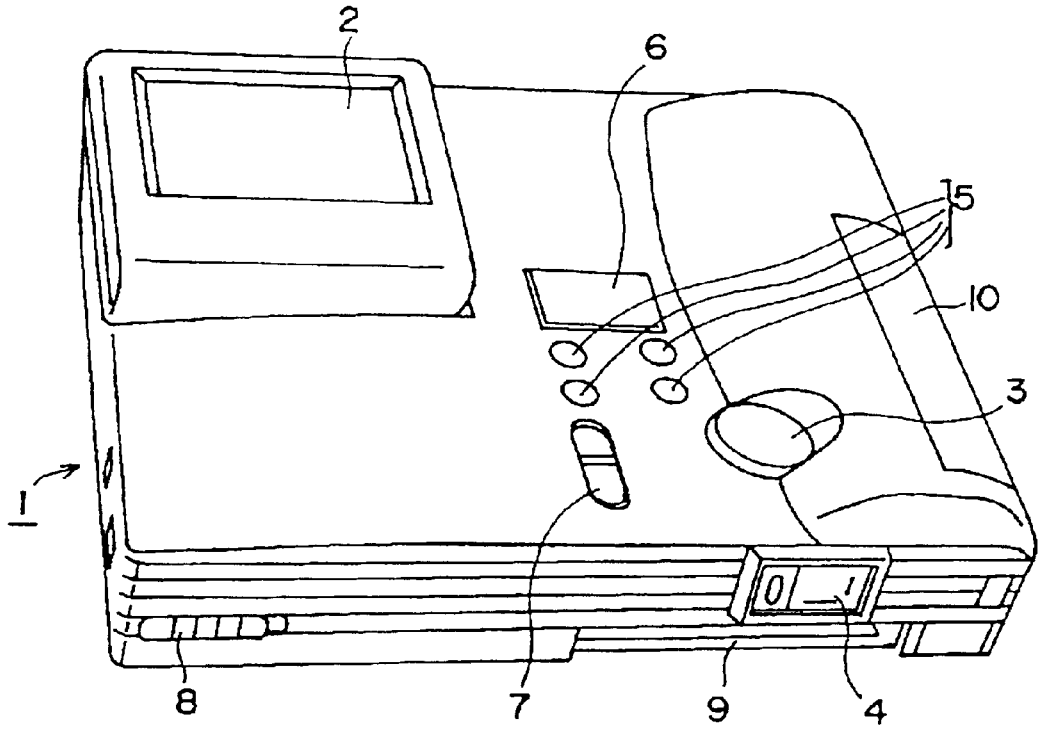
FIG. 1 is a perspective view of a digital camera having a liquid crystal monitor according to the present invention.
Figure 2:
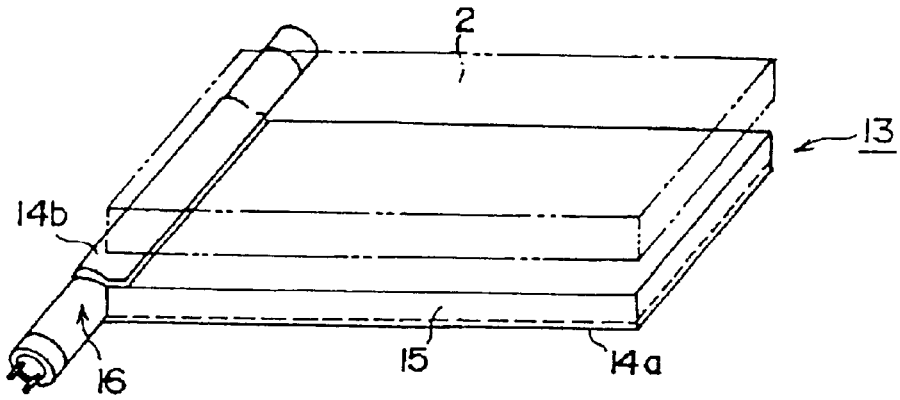
FIG. 2 is a perspective view of a backlight portion of an LC monitor lighting apparatus according to the present invention.
Figure 3:
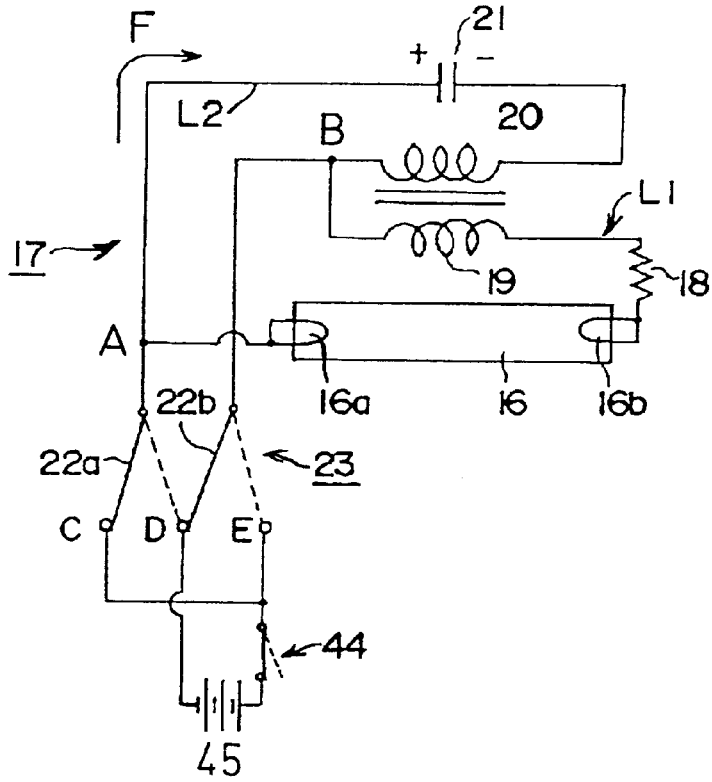
FIG. 3 is a circuit diagram of a DC lighting circuit for an LC monitor lighting apparatus and a switching circuit, according to the present invention.

As shown in FIG. 1, a digital camera having a liquid crystal (LC) monitor includes a camera body 1, an LC monitor 2, a shutter button 3, a finder window 4, a mode selection button 5, an external display portion 6, a main switch 7, a contrast adjusting knob 8, a memory card insertion opening 9, and a battery compartment lid 10. An LC monitor illuminating apparatus is provided behind the LC monitor 2 and includes a backlight portion 13, a DC (direct-current) lighting circuit 17 and a switching circuit 23, as shown in FIGS. 2 and 3. Each element of the LC monitor illuminating apparatus will be discussed hereinafter.

Figure 4:
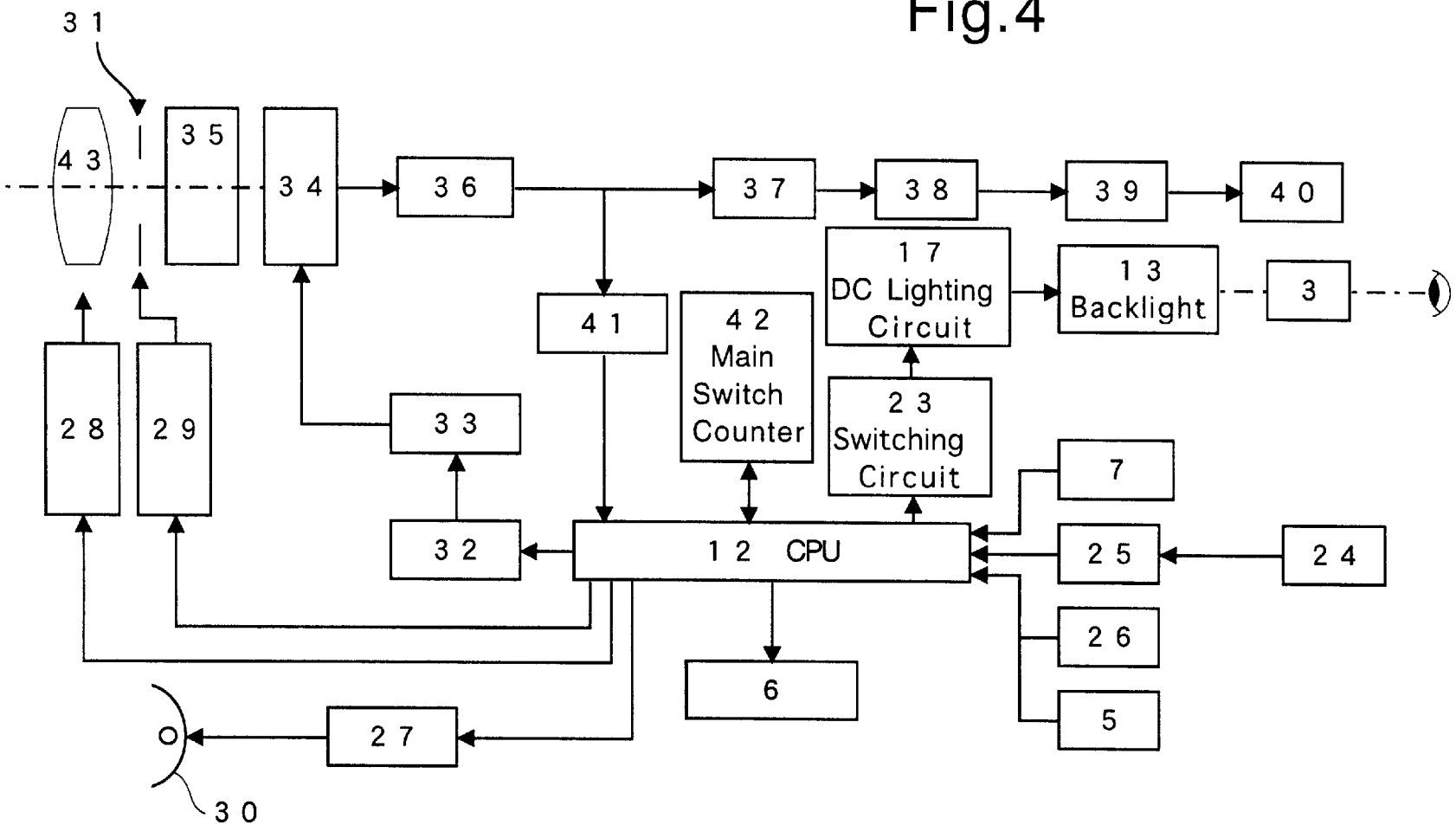
FIG. 4 is a block diagram of a digital camera having an LC monitor and a system to reverse the polarity of a DC lighting circuit in accordance with values of a main switch counter.

The digital camera body 1 which sends indication data to the LC monitor is provided therein with a CPU 12 shown in FIG. 4. Data is sent to the CPU 12 from the main switch 7, from a photometering switch/release switch 26, from the mode selection button 5 and from an exposure control circuit 41.

The CPU 12 supplies signals to a strobe control circuit 27, an AF drive mechanism 28, a diaphragm drive mechanism 29, and a clock generator 32, based on the input data. Consequently, a strobe device 30, a diaphragm 31, and a CCD driver 33 are driven in accordance with the respective signals supplied from the CPU 12, so that an object image taken by a CCD 34 through a photographing lens 43 and an optical low-pass filter 35 is recorded in a memory card 40 via an amplifier circuit 36, an A/D converter circuit 37, a signal processing circuit 38, and a compression circuit 39. The CPU 12 causes the external display 6 to indicate photographing data.

A battery 24 is used as a power source for the above-mentioned circuits. Power from the battery 24 is supplied through the DC-DC converter 25.

The functions of these circuits, which are well known in the art, are not the subject of the present invention, and hence, no detailed explanation therefor will be given herein.

The CPU 12 is connected to a main switch counter 42, so that the main switch counter 42 is alternately set to 0 or 1 each time the power-on signal (which is issued when the main switch 7 is turned ON) is input to the CPU 12. The CPU 12 supplies a polarity reversing signal to the switching circuit 23 of the LC monitor illuminating apparatus in accordance with the set value of the main switch counter 42, so that the switching circuit 23 reverses the polarity of the DC lighting circuit 17 which is adapted to light the fluorescent lamp 16 (i.e., to activate the backlight 13) in accordance with the polarity reversing signal.

The backlight 13 includes reflecting plates 14*a*, 14*b*, a light guide layer 15 and the fluorescent lamp 16. Namely, the light guide layer 15 is formed on the reflecting plate or sheet 14*a*. The LC monitor 2 is located above the backlight 13, as shown in FIG. 2. The fluorescent lamp 16 which is covered by the reflecting plate 14*b* at the portion that is not in contact with the light guide layer 15 is located on the side of the light guide layer 15. Light emitted from the fluorescent lamp 16 is repeatedly reflected by the upper surface of the light guide layer 15 and the lower reflecting plate 14*a*, and is diffused. The light which reaches the upper surface of the light guide layer 15 partly passes therethrough and is emitted therefrom. Thus, the upper surface of the light guide layer 15 forms a surface light source from which the light is substantially uniformly emitted to illuminate the LC monitor 2.

The fluorescent lamp 16 is activated by a DC power source 45. A lamp lighting circuit to activate the fluorescent lamp 16 is made of, for example, a kick-type DC lighting circuit 17, as shown in FIG. 3.

The DC lighting circuit 17 includes a series circuit L1 in which a resistor 18 and a secondary winding 19 are connected in series to one of the electrodes, i.e., the electrode 16*b* of the fluorescent lamp 16; and a series circuit L2 in which the primary winding 20 and a condenser 21 are connected in series. The series circuits L1 and L2 are connected in parallel at contacts A and B.

The DC lighting circuit 17 is connected to a switching circuit 23 which is provided with movable switches 22*a* and 22*b*. The contact A is connected to the movable switch 22*a* and the contact B is connected to the movable switch 22*b*.

The DC power source 45 is provided with a power switch 44 and stationary contacts C, D, and E. The power switch 44 is closed or opened in response to a signal from the main switch 7.

The switching circuit 23 mechanically or electrically moves the movable switch 22*a* or 22*b* to the stationary contact C or E, respectively, on the positive terminal side of the DC power source 45, and simultaneously moves the other respective movable switch 22*b* or 22*a* to the stationary contact D on the negative side of the DC power source, according to the polarity reversing signal supplied from the CPU 12.

If the main switch 7 is turned ON, the power switch 44 is closed and the movable switches 22*a* and 22*b* are connected to the stationary contacts C and D, respectively.

Since the voltage necessary to light the fluorescent lamp 16 cannot be obtained from the DC power source 45, no electric current flows in the series circuit L1 of the DC lighting circuit 17.

The transient electric current flows in the condenser 21 and the winding 20 of the series circuit L2 in the direction F, so that the electric charges are accumulated in the condenser 21.

Since the winding 19 of the transformer whose winding direction is opposite to the winding 20 is boosted due to the transient current flowing in the winding 20, a sufficient potential difference necessary to light the fluorescent discharge lamp 16 is produced between the poles (terminals) 16*a* and 16*b* of the fluorescent lamp 16. If a sufficient amount of electric charges is accumulated in the condenser 21 so that no current flows in the series circuit L2, the electric current flows in the series circuit L1 due to the potential difference produced in the winding 19, and thus the fluorescent lamp 16 is lit.

As an alternative, the main switch 7 is turned OFF, so that the movable switches 22*a* and 22*b* are disconnected from the stationary contacts C, D, and E. In this arrangement, the power switch is rendered unnecessary.

Since the polarity of the DC lighting circuit 17 is switched every time the main switch 7 is turned ON, if the main switch 7 is subsequently turned ON, the movable switch 22*a* is connected to the stationary contact D and the movable switch 22*b* is connected to the stationary contact E.

As can be understood from the foregoing, since the polarity of the fluorescent lamp 16 at both electrodes (terminals) thereof is switched every time the main switch 7 is turned ON, it is possible to prevent the polarity of each electrode of the fluorescent lamp 16 from always being identical. Consequently, blackening phenomenon of the fluorescent lamp 16 in the vicinity of only one of the electrodes thereof can be inhibited.

It is possible to periodically switch the polarity of the DC lighting circuit 17 at predetermined intervals, instead of the switching by each operation of the main switch 7.

Figure 5:
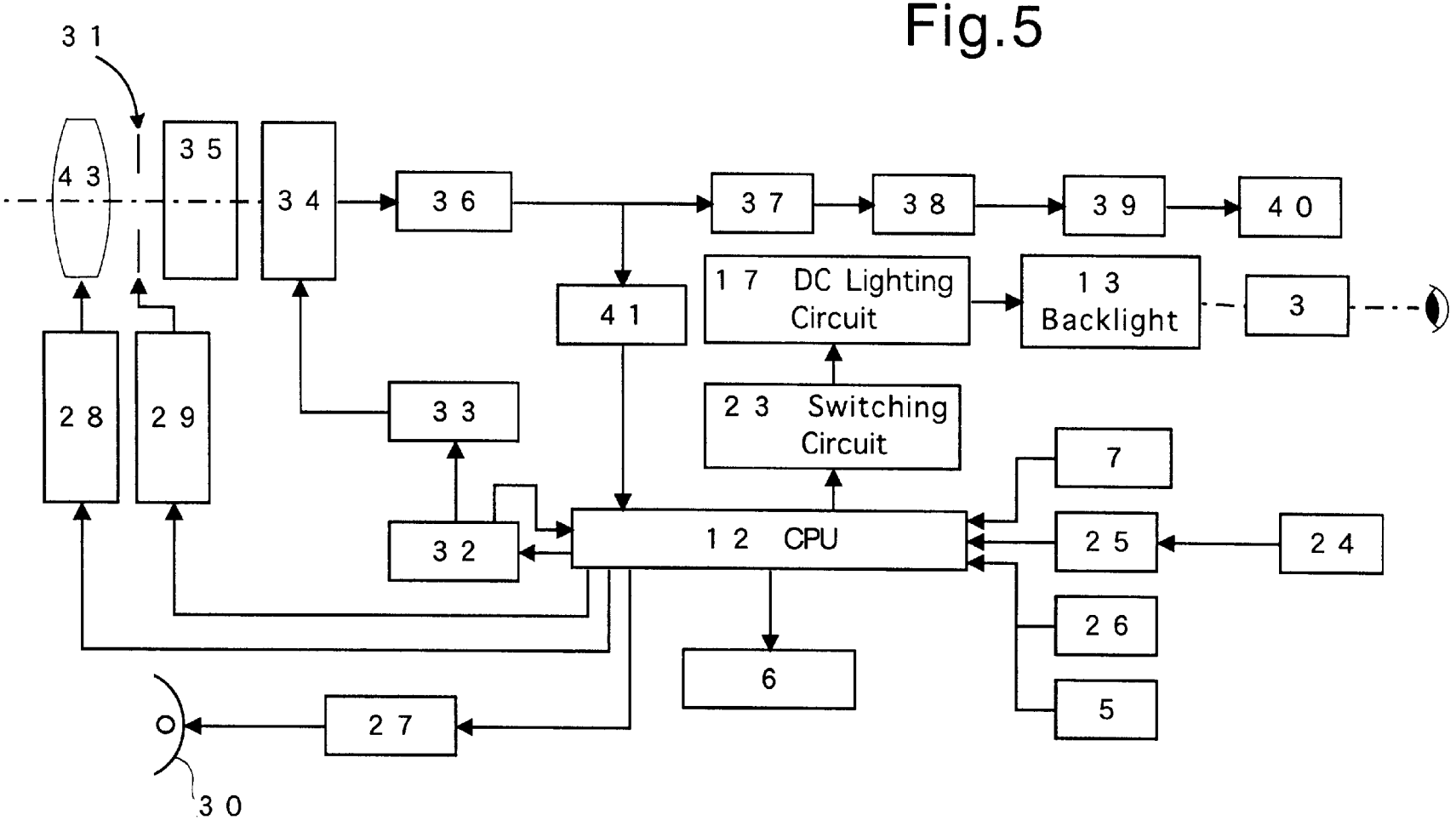
FIG. 5 is a block diagram of a digital camera having an LC monitor and a system to control the reversal of the polarity of a DC lighting circuit, in accordance with clock pulses generated from a clock generator, according to the present invention.

In the block diagram shown in FIG. 5, instead of providing a main switch counter 42, the clock pulses are input to the CPU 12 from the clock generator 32. The CPU 12 detects the clock pulses and measures the elapsed time, and outputs the polarity reversing signals to the switching circuit 23 at a predetermined time interval, based on the measured lapse time. The switching circuit 23 reverses the polarity of the DC lighting circuit 17 in accordance with the polarity reversing signals input thereto to light the fluorescent lamp 16 to thereby illuminate the LC monitor 2. The remaining structure of FIG. 5 is the same as that shown in FIG. 4.

As may be understood from the above discussion, in an LC monitor illuminating apparatus and a digital camera having an LC monitor using the illuminating apparatus, if the fluorescent lamp of the backlight portion is activated by the DC lighting circuit to obtain a clear LC monitor display in which noise caused by the invertor is restricted, since the polarity of the DC lighting circuit is reversed in accordance with predetermined conditions, a blackening phenomenon of the fluorescent lamp can be inhibited. Consequently, the service life of the LC monitor can be prolonged.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A liquid crystal monitor illuminating apparatus in which a fluorescent lamp is provided in a backlight portion to illuminate a liquid crystal monitor from behind, comprising:

a direct-current lighting circuit configured to activate said fluorescent lamp by directly applying direct-current generated from said direct-current lighting circuit to said fluorescent lamp; and a switching circuit configured to reverse the polarity of said direct-current directly applied to said fluorescent lamp, every time said fluorescent lamp is activated.

2. A liquid crystal monitor illuminating apparatus according to claim 1, wherein said switching circuit is configured to reverse the polarity of said direct-current directly applied to said fluorescent lamp, only when said fluorescent lamp is activated.

3. A liquid crystal monitor illuminating apparatus in which a fluorescent lamp is provided in a backlight portion to illuminate a liquid crystal monitor from behind, comprising:

a direct-current lighting circuit configured to activate said fluorescent lamp by directly applying direct-current generated from said direct-current lighting circuit to said fluorescent lamp; and a switching circuit configured to reverse the polarity of said direct-current directly applied to said fluorescent lamp, every time a main switch, provided on a main body which sends indication data to said liquid crystal monitor, is turned ON.

4. A liquid crystal monitor illuminating apparatus according to claim 3 wherein said switching circuit is configured to reverse the polarity of said direct-current directly applied to said fluorescent lamp, only when the main switch is turned ON.

5. A liquid crystal monitor illuminating apparatus in which a fluorescent lamp is provided in a backlight portion to illuminate a liquid crystal monitor from behind, comprising:

a direct-current lighting circuit configured to activate said fluorescent lamp by directly applying direct-current generated from said direct-current lighting circuit to said fluorescent lamp; and a switching circuit configured to reverse the polarity of said direct-current directly applied to said fluorescent lamp, at a predetermined time interval.

6. A liquid crystal monitor illuminating apparatus according to claim 5, wherein said predetermined time interval is determined by a CPU, in accordance with a time which is measured by measuring clock pulses which are generated by a clock generator which sends indication data to the LC monitor.

7. A liquid crystal monitor illuminating apparatus according to claim 5, wherein said switching circuit is configured to reverse the polarity of said direct-current directly applied to said fluorescent lamp, only at the predetermined time interval.

* * * * *